US006655603B2

(12) United States Patent
Long et al.

(10) Patent No.: US 6,655,603 B2
(45) Date of Patent: Dec. 2, 2003

(54) REVERSE FLOW VALVE FOR FUEL INJECTORS

(75) Inventors: Michael C. Long, Germantown Hills, IL (US); Xinshuang Nan, Bloomington, IL (US); Hrishikesh D. Thaker, Peoria, IL (US); Sudhindra K. Ayanji, Peoria, IL (US); Victor I. Yacoub, Pontiac, IL (US); Goudarz Haji, Normal, IL (US)

(73) Assignee: Caterpillar Inc, Peoria, IL (US)

( * ) Notice: Subject to any disclaimer, the term of this patent is extended or adjusted under 35 U.S.C. 154(b) by 41 days.

(21) Appl. No.: 10/125,262

(22) Filed: Apr. 18, 2002

(65) Prior Publication Data

US 2003/0116639 A1 Jun. 26, 2003

Related U.S. Application Data

(63) Continuation of application No. 10/029,411, filed on Dec. 20, 2001, now abandoned.

(51) Int. Cl.[7] ..... F02D 1/06

(52) U.S. Cl. ..... 239/5; 239/88; 239/92; 239/533.9

(58) Field of Search ..... 239/88, 92, 96, 239/533.3, 533.9, 569, 570, 584, 5; 123/446, 467, 506

(56) References Cited

U.S. PATENT DOCUMENTS

| | | | | |
|---|---|---|---|---|
| 3,115,304 A | * | 12/1963 | Humphries | 239/584 |
| 5,287,838 A | | 2/1994 | Wells | |
| 5,505,384 A | * | 4/1996 | Camplin | 239/92 |
| 5,641,121 A | * | 6/1997 | Beck et al. | 239/92 |

* cited by examiner

*Primary Examiner*—Steven J. Ganey
(74) *Attorney, Agent, or Firm*—Liell & McNeil

(57) ABSTRACT

A reverse flow valve member is positioned within an injector body of a fuel injector and is movable between a closed position and an open position. When the reverse flow valve member is in its closed position, an upper portion of a nozzle supply passage is blocked from fluid communication with a lower portion of the nozzle supply passage. A compressed spring biases the reverse flow valve member to its closed position. When the reverse flow valve member is in its open position, the fuel pressurization chamber is fluidly connected to the lower portion of the nozzle supply passage. The present invention limits gas ingestion due to tip leakage, and allows an injector with trapped gas to prime itself.

10 Claims, 5 Drawing Sheets

REVERSE FLOW VALVE FOR FUEL INJECTORS

RELATION TO OTHER PATENT APPLICATION

This application is a continuation of application Ser. No. 10/029,411, filed Dec. 20, 2001, which is now abandoned.

TECHNICAL FIELD

This invention relates generally to fuel injectors, and more specifically to reverse flow check valves within fuel injectors.

BACKGROUND

Occasionally, an injector nozzle of a fuel injector will become leaky, and after an injection event, allow hot combustion gases from the engine cylinder to leak past the nozzle outlet and travel upwards into the nozzle supply passage of the fuel injector. If the gases are permitted to continue to travel upwards and reach the fuel pressurization chamber, the fuel injector will inject less than a predicted amount of fuel, and can eventually be unable to pressurize fuel and inject it into the engine cylinder.

Typically, gases have been blocked from the fuel pressurization chamber by reverse flow check valve assemblies having a variety of structures. One example of such a check valve assembly is shown in co-owned U.S. Pat. No. 5,287,838 issued to Wells on Feb. 22, 1994. The function of the check valve assembly is to permit communication of high pressure fuel from the fuel pressurization chamber to the nozzle outlet of the fuel injector during an injection phase, but to prevent communication (i.e., reverse flow) of engine cylinder combustion gas from the nozzle to the fuel pressurization chamber at the end of an injection event and during a non-injection phase if the nozzle of the fuel injector becomes leaky.

Referring to FIG. 1, there is shown a partial sectioned side diagrammatic view of a fuel injector 10 according to the above identified patent. The fuel injector 10 consists of an injector body 11 that includes a barrel 33 separated from a stop component 42 by a relatively thin plate 50. A plunger 13 is movably positioned along a centerline 12 within the injector body 11. The plunger 13, the barrel 33 and the plate 50 define a fuel pressurization chamber 14 that is fluidly connected to a fuel tank (not shown) via a fuel supply line 30. When the plunger 13 is driven downward, it advances along the centerline 12 in order to pressurize fuel delivered from the fuel tank (not shown) via the fuel supply line 30. A check valve 32 is positioned within the fuel supply line 30. The check valve 32 is in its closed position in which it blocks fluid communication between the fuel pressurization chamber 14 and the fuel supply line 30 when the plunger 13 is advancing downward and increasing the pressure within the fuel pressurization chamber 14. When the plunger 13 is returning to its upward position, the pressure within the pressurization chamber 14 decreases such that the check valve 32 opens and low pressure fuel within the fuel supply line 30 can flow past the check valve 32 and into the fuel pressurization chamber 14.

The injector body 11 defines a nozzle supply passage 15, a nozzle outlet 17, and a guide bore 54. A needle valve is positioned in the injector body 11 and has a needle valve member 20 that is movable between a first position, in which the nozzle outlet 17 is open, and a second position, in which the nozzle outlet 17 is closed. The needle valve member 20 has an opening hydraulic surface 21 that is exposed to fluid pressure within the nozzle supply passage 15, but is biased toward a closed position by a compressed spring 22. When the needle valve member 20 is in its open position, a stop surface of the needle valve member 20 is in contact with the stop component 42, and the nozzle outlet 17 is opened to allow pressurized fuel to be injected into the engine cylinder (not shown).

The fuel pressurization chamber 14 is fluidly connected to the nozzle outlet 17 via the nozzle supply passage 15, which includes the guide bore 54. Positioned within the guide bore 54, there is a reverse flow check valve assembly that includes a reverse flow check 52, the plate 50, and the stop component 42. The reverse flow check 52 is preferably a flat circular plate and defines a flow passage 53. The flow passage 53 is preferably cylindrical and centrally positioned within the reverse flow check 52 and is fluidly connected to the nozzle supply passage 15. The plate 50, which is preferably flat, is positioned between the barrel 33 and the stop component 42 and defines a pair of kidney-shaped or crescent-shaped holes 51, which are fluidly connected to the fuel pressurization chamber 14. The flow passage 53 of the reverse flow check 52 is radially inwardly spaced from the kidney holes 51 of the plate 50 and is arranged so that the nozzle supply passage 15 is blocked from the pressurization chamber 14 when the reverse flow check 52 and the plate 50 are in contact. The reverse flow check 52 is movable between an open position and closed position. When in its open position, as shown, the reverse flow check 52 is in contact with the stop component 42, and the fuel pressurization chamber 14 is fluidly connected to the nozzle supply passage 15 via the kidney holes 51 of the plate 50 and the flow passage 53 of the reverse flow check 52.

Prior to an injection event, the plunger 13 is driven downward by a hydraulic intensifier piston or a tappet along a centerline 12 of the fuel injector 10 toward its downward position. This greatly increases the pressure within the upper portion of the nozzle supply passage 15 which includes the fuel pressurization chamber 14 and the lower portion of the nozzle supply passage 15. The increased pressure within the fuel pressurization chamber 14 will also close the check valve 32, blocking fluid communication between the fuel pressurization chamber 14 and the fuel tank (not shown) via the fuel supply line 30. The reverse flow check 52 will be in its first, or open, position, and in contact with the stop component 42. Thus, the pressurized fuel will flow from the fuel pressurization chamber 14 through kidney holes 51 within the plate 50 and through the flow passage 53 of the reverse flow check 52 to the lower portion of the nozzle supply passage 15. Thus, during an injection event, the fuel pressurization chamber 14 is fluid connected to the lower portion of the nozzle supply passage 15.

Shortly before the desired amount of pressurized fuel is injected into the engine cylinder via the nozzle outlet 17 of the fuel injector 10, the plunger 13 will stop moving downward, resulting in a fuel pressure drop to below valve closing pressure. This causes the needle valve member 20 to move to its closed position under the action of spring 22. Towards the end of the movement of the needle valve member 20 to its closed position, there is a reverse flow of pressurized fuel within the lower portion of the nozzle supply passage 15. The reverse flow of fuel will lift the reverse flow check 52 out of contact with the stop component 42. The reverse flow check 52 will be lifted upward until it is in contact with the plate 50 and, thus, in its second, or closed, position. Due to the positioning and placement of the kidney holes 51 of the plate 50 and the flow passage 53 of the reverse flow check 52, fluid communication between the fuel pressurization chamber 14 and the nozzle supply passage 15 will be blocked. Gas ingestion can occur over a brief instant as the needle valve member 20 is not yet closed while fuel pressure has dropped below cylinder pressure. If any engine cylinder combustion gases enter through the nozzle outlet 17 into the lower portion of the nozzle supply passage 15, they will be blocked from fluid communication with the fuel pressurization chamber 14 when the reverse flow check 52 is in its closed position. Thus, the prior injector prevents gas from being trapped within the fuel pressurization chamber 14 by utilizing the reverse flow check 52, the plate 51, and the stop component 42.

The hydraulic pressure acting on the plunger 13 is then reduced allowing the plunger 13 to retract along the centerline 12 to its upward position under the action of its biasing spring 16. As the plunger 13 retracts, the pressure within the fuel pressurization chamber 14 preferably will lessen such that fuel from the fuel tank (not shown) can be drawn into the fuel pressurization chamber 14 via the fuel supply line 30 past the check valve 32. The injection process can once again begin.

Although these reverse flow check valve assemblies have performed well, there is room for improvement. For instance, the reverse flow check valve assemblies limit combustion gases from leaking into the fuel pressurization chamber 14 through the nozzle outlet 17 by blocking fluid communication between the lower portion of the nozzle supply passage 15 and the fuel pressurization chamber 14 toward the end of an injection event. However, the reverse check valve assemblies do not prevent all gases ingested through the nozzle outlet 17 from traveling to the fuel pressurization chamber 14. Because the reverse flow check 52 remains in the closed position only for a limited time when the reverse flow of fuel is hydraulically displacing it, there is the possibility that combustion gases can leak past the nozzle outlet 17 after the hydraulic pressure caused by the reverse flow of fuel within the nozzle supply passage has subsided. This can occur due to excessive wear on the needle valve seat. Further, the reverse control valve assembly cannot prevent gases from leaking into the fuel pressurization chambers 14 by other means than gas ingestion through the nozzle outlet 17. Theoretically, gas trapping may occur if t hot combustion gases leak past seals on the outer surface of the fuel injector 10 and travel upward along the outer surface of the fuel injector 10 until they reach the area in the engine head where the fuel supply line 30 exists. The gases then mix with the low pressure fuel and are delivered to the fuel pressurization chamber 14.

Occasionally, hot combustion gases are ingested through the injector tip and/or enter via the fuel supply are trapped within the fuel pressurization chamber 14 and the nozzle supply passage 15 by the check valve 32 and the direct needle control valve member 20. The trapped gas creates pressure within the fuel pressurization chamber 14 sufficient to prohibit the check valve 32 from rising off its seat and allowing low pressure fuel into the fuel pressurization chamber 14. Thus, the fuel pressurization chamber 14 is blocked from fluid communication with the fuel supply line 30 by the check valve 32. The pressure caused by the trapped gas acting on the opening hydraulic surface 21 within the nozzle supply passage 15 is sometimes not great enough to overcome the biasing spring 22 of the needle valve member 20. Thus, the nozzle supply passage 15, is blocked from fluid communication with the nozzle outlet 17. When this gas trapping occurs, the plunger 13 will advance downward to pressurize the fuel, but there will be little or no fuel within the fuel pressurization chamber 14 because the fuel pressurization chamber 14 is blocked from the fuel supply line 30 by the closed check valve 32. The gas can never reach a high enough pressure to open the needle valve member 20 and the gas pressure never drops low enough to allow the check valve 32 to lift to its open position to allow fuel into the fuel pressurization chamber 14. Thus, the plunger 13 reciprocates up and down but nothing happens with the fuel injector 10. In these cases, the fuel injector 10 needs a means for re-priming itself.

Also, during assembly of new fuel injectors 10, gases, other than engine cylinder gases, can be trapped within the empty space within the fuel pressurization chambers 14. If the gas trapping occurs in a new fuel injector 10, the fuel injector 10 is unable to prime itself and inject fuel into the engine cylinder. If the gas trapping occurs during operation of a fuel injector 10, the fuel injector 10 is unable to re-prime itself by pushing the gases out of the nozzle outlet 17. In either situation, once gases are in the fuel pressurization chamber 14, the pressure within the nozzle supply passage 15 will be insufficient to open the nozzle outlet 17 and the pressure within the fuel pressurization chamber 14 will be too great for the check valve 32 to open. Thus, because the fuel injector 10 has no way of pushing the gas pressure out of the fuel pressurization chamber 14, the plunger 13 will reciprocate up and down and nothing will happen within the fuel injector 10.

Moreover, the plate 50 used as a stop for the reverse flow check 52 is subject to fretting, and the thin plate decreases the available height of the stop component 42 which in return increases the risk of oil to fuel transfer.

The present invention is directed to overcoming one or more of the problems set forth above.

SUMMARY OF THE INVENTION

In one aspect of the invention, a fuel injector comprises an injector body that defines a nozzle supply passage and a nozzle outlet. Within the injector body is positioned a reverse flow valve member that has an opening hydraulic surface exposed to fluid pressure in an upper portion of the nozzle supply passage. The reverse flow valve member is moveable between a closed position in which the nozzle supply passage is blocked and an open position in which the nozzle supply passage is open. The reverse flow valve member is biased toward the closed positioned by a compressed spring.

In another aspect, a fuel injector includes an injector body defining a nozzle outlet. The injector body also includes a barrel that is in contact with a stop component. A movable plunger is at least partially positioned in the barrel. A reverse flow valve member is trapped between the barrel and the stop component, and is movable between a first position and a second position. The plunger, the reverse flow valve member, and the injector body define a nozzle supply passage that includes a fuel pressurization chamber. When the reverse flow valve member is in the second position, the nozzle supply passage is fluidly connected to a lower portion of the nozzle supply passage. A compressed spring is operably positioned in the injector body to bias the reverse flow valve member toward the first position, in which the fuel pressurization chamber is blocked from the lower portion of the nozzle supply passage.

In still another aspect, gas ingestion in a fuel injector is reduced by moving a reverse flow valve member at least in part with a spring to a position that blocks a downstream portion of a nozzle supply passage to an upstream portion of the nozzle supply passage.

DETAILED DESCRIPTION

Figure 1:
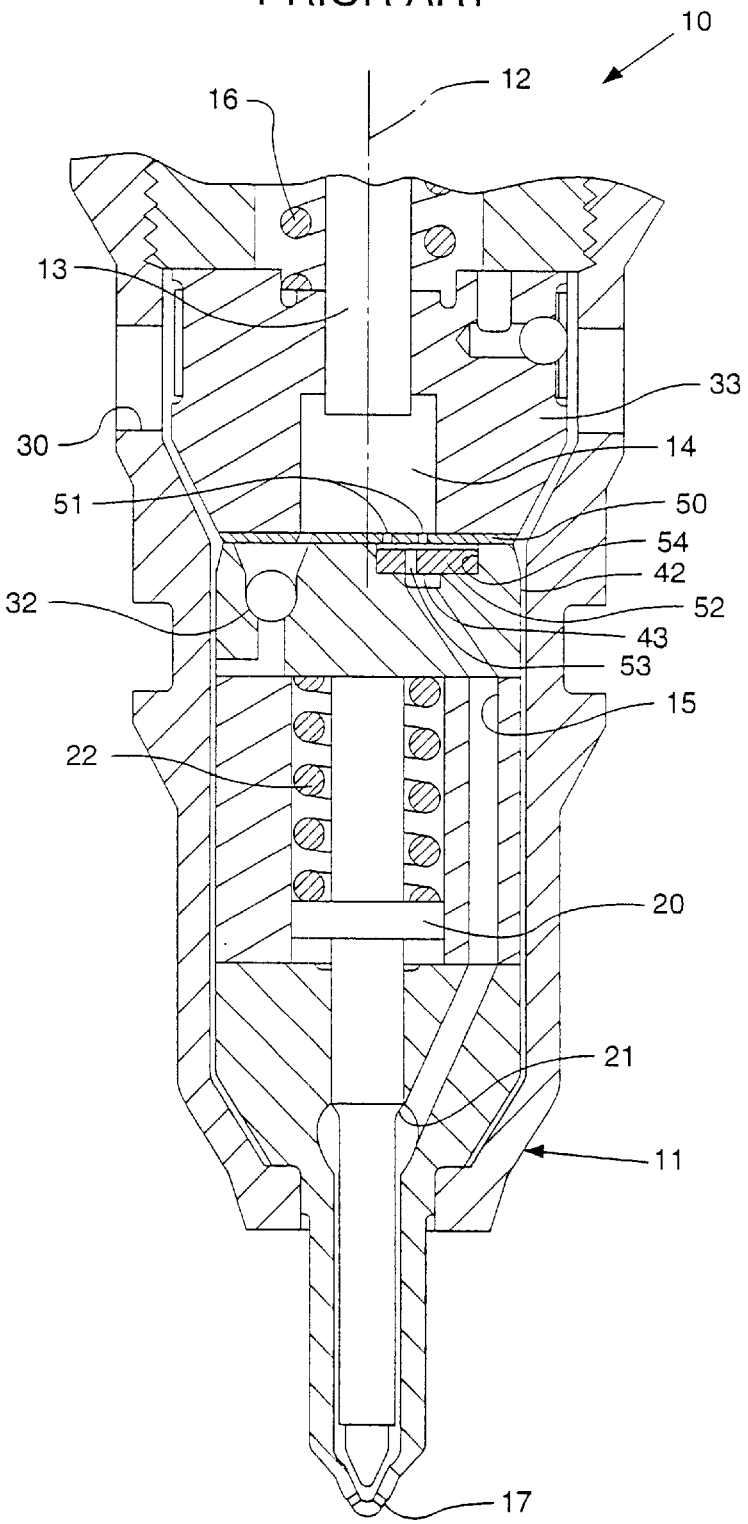
Fig. 1 PRIOR ART
FIG. 1 is a partial sectioned side diagrammatic view of a fuel injector according to the prior art.
Figure 2:
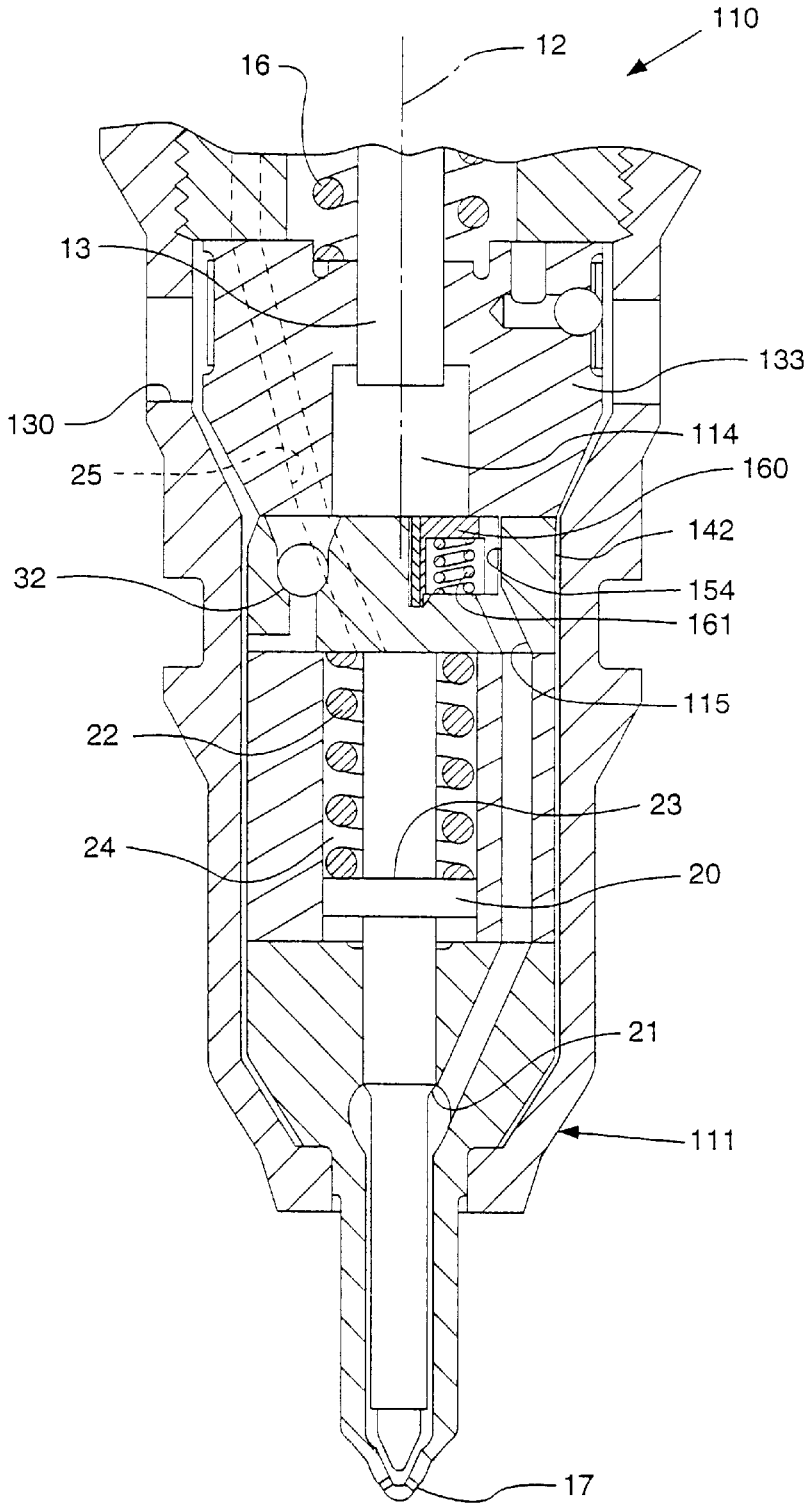
FIG. 2 is a partial sectioned side diagrammatic view of a fuel injector according to the preferred embodiment of the present invention.

Referring to FIG. 2, there is shown a partial sectioned side diagrammatic view through a fuel injector 110 according to the present invention. The fuel injector 110 includes an injector body 111 that includes a barrel 133 and a stop component 142. Features of fuel injector 110 that are identical to those described with respect to fuel injector 10 of FIG. 1 have identical numbering. A plunger 13 is movably positioned along a centerline 12 within the injector body 111. While the plunger 13, the barrel 33 and a thin plate 50 define a pressurization chamber 14 according to the prior art as illustrated in FIG. 1, the injector body 111, the plunger 13, and a reverse flow valve member 160 define a nozzle supply passage 115 that includes a fuel pressurization chamber 114 according to the present invention as illustrated in FIG. 2. The fuel pressurization chamber 114 is fluidly connected to a fuel tank (not shown) via a fuel supply line 130. When plunger 13 is hydraulically-activated, it advances downward along the centerline 12 in order to pressurize fuel delivered from the fuel tank (not shown) via the fuel supply line 130. A check valve 32 is positioned within the fuel supply line 130. The check valve 32 is in its closed position in which it blocks fluid communication between the fuel pressurization chamber 114 and the fuel supply line 130 when the plunger 13 is advancing downward and increasing the pressure within the pressurization chamber 114. When the plunger 13 is returning to its upward position, the pressure within the pressurization chamber 114 decreases such that the check valve 32 opens and low pressure fuel within the fuel supply line 130 can flow past the check valve 32 and into the pressurization chamber 114.

The injector body 111 defines a nozzle outlet 17 and a nozzle supply passage 115, which includes a guide bore 154. A direct control needle valve is positioned in the injector body 11 and has a direct control needle valve member 20 that is movable between a first position, in which the nozzle outlet 17 is open, and a second position, in which the nozzle outlet 17 is closed. When the direct control needle valve member 20 is in the second, or open, position, the direct control needle valve member 20 is in contact with the stop component 142. The direct control needle valve member 20 has an opening hydraulic surface 21 that is exposed to fluid pressure within the nozzle supply passage 115 and a closing hydraulic surface 23 that is exposed to fluid pressure within a needle control chamber 24. A pressure communication passage 25 is in fluid communication with the needle control chamber 24 and controls fluid pressure within the same. The closing hydraulic surface 23 and the opening hydraulic surface 21 are preferably sized such that even when a valve opening pressure is attained in the nozzle supply passage 115, the direct control needle valve member 20 will not lift open when the needle control chamber 24 is fluidly connected to a source of high pressure actuation fluid. However, it should be appreciated that the relative sizes of the closing hydraulic surface 23 and the opening hydraulic surface 21 should be such that when the closing hydraulic surface 23 is exposed to low pressure in the needle control chamber 24, the high pressure fuel acting on the opening hydraulic surface 21 should be sufficient to move the direct control needle valve member 20 upward against the force of its biasing spring 22 to open the nozzle outlet 17. Those skilled in the art should appreciate that while direct control needle valve is the preferred method of controlling the nozzle outlet 17, a nozzle outlet valve solely controlled by the biasing spring 22 and the hydraulic pressure within the nozzle supply passage 115 may also be used in the present invention.

Figure 3:
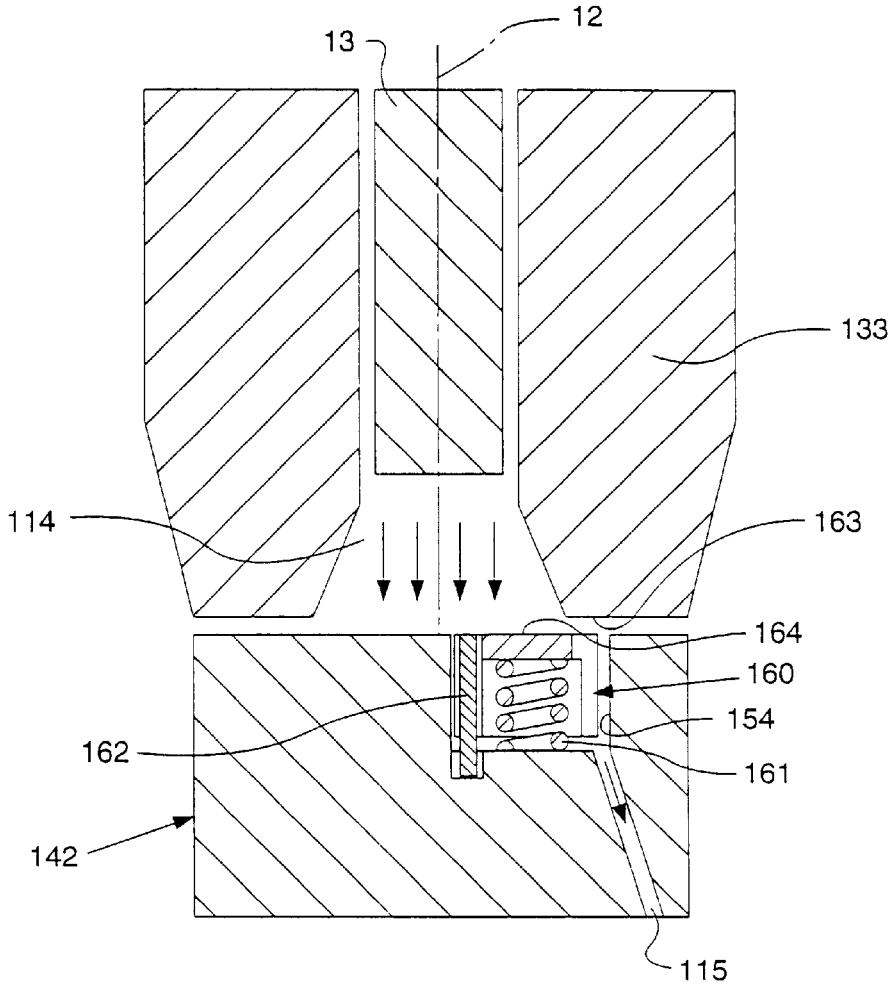
FIG. 3 is an enlarged view of the reverse flow valve member positioned within the fuel injector of FIG. 2.
Figure 4:
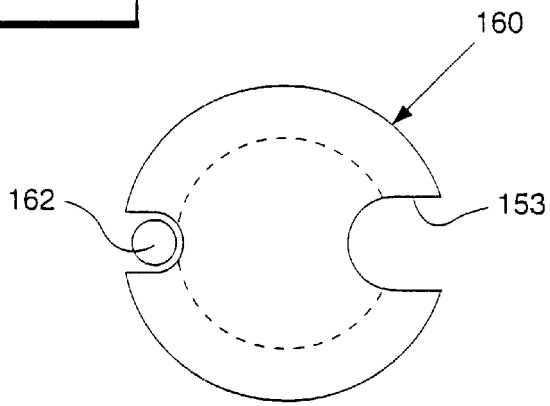
FIG. 4 is a top view of the reverse flow valve member shown in FIG. 3 and FIG. 2.

The injector body 111, the plunger 13, and a reverse flow valve member 160 define the nozzle supply passage 115, which includes the fuel pressurization chamber 114. Although the described fuel injector 110 includes a fuel pressurization chamber 114, those skilled in the art will appreciate that the present invention could be utilized in a common rail fuel injector in which there is no fuel pressurization chamber. Rather than the plate 50 being positioned between the barrel 33 and the stop component 42 as it is in the fuel injector 10 according to the prior art, a barrel 133 and a stop component 142 are in contact in the fuel injector 110 according to the present invention. It should also be appreciated that, by removing the plate 50, the height of the stop component 142 can be increased, which should reduce the oil to fuel transfer and prevent fretting that sometimes occurs in plate 50. Further, by removing the plate 50 from the present invention, the plate breakage that could occur over time is no longer a concern. A reverse flow valve member 160 is positioned within the guide bore 154 and is trapped between the barrel 133 and the stop component 142. Although it could be positioned at any point along the nozzle supply passage 115, the reverse flow valve member 160 preferably is positioned as close to the plunger 13 as possible so that the reverse flow valve member 160 can aid in priming a new fuel injector 110 in the event gas is trapped within its fuel pressurization chamber 114 upon assembly. The reverse flow valve member 160 member is movably positioned along a line parallel to and offset a distance, from the centerline 12 of the injector body 111. The reverse flow valve member 160 is movable between a first position, or closed position, in which the lower portion of the nozzle supply passage 115 is blocked from fluid communication with the fuel pressurization chamber 114, and a second position, or open position, in which the lower portion of the nozzle supply passage 115 is open to fluid communication with the fuel pressurization chamber 114. The reverse flow valve member 160 is biased to its first position by a compressed spring 161 operably positioned in the injector body Referring to FIG. 3 and FIG. 4, there is shown an enlarged view and a top view of the reverse flow valve member 160 of FIG. 2, respectively. In the preferred embodiment, the reverse flow valve member 160 has a cupped shape and defines a hollow interior in which a compressed spring 161 is operably positioned to bias the reverse flow valve member 160 toward its upward, closed position. The reverse flow valve member 160 has an opening hydraulic surface 164 exposed to fluid pressure within the fuel pressurization chamber 114 that is part of the upstream portion of the nozzle supply passage 115. When the plunger 13 advances downward to pressurize fuel within the fuel pressurization chamber 114, the increased pressure within the fuel pressurization chamber 114 acting on the opening hydraulic surface 164 moves the reverse flow valve member 160 against the action of its compressed spring 161 to its open position in which it is not in contact with a flat valve seat 163 of the barrel 133. In its open position or its second position, as shown, the reverse flow valve member 160 defines a groove 153 that fluidly connects the fuel pressurization chamber 114 that is included in the upper portion of the nozzle supply passage 115 to the lower portion of the nozzle supply passage 115. Toward the end of an injection event, the decreased pressure acting on the opening hydraulic surface 164 permits the reverse flow valve member 160 to return in its closed, or first, position, in which the reverse flow valve member 160 is in contact with the flat valve seat 163 of the barrel 133 and, thus, blocks fluid communication between the fuel pressurization chamber 114 and the nozzle supply passage 115, and vice versa. The size of the groove 153 is preferably selected such that it is large enough to communicate a portion of the required fuel to flow past the reverse flow valve member 160 during an injection event but small enough that there is no leakage between the reverse flow valve member 160 and the valve seat 163 of the barrel 133 during a non injection period.

While the prior art solely relied on of the pressure gradient between the fuel pressurization chamber 14 and the lower portion or the nozzle supply passage 15 to control the movement of the reverse flow check 52, the present invention uses the compressed spring 161 positioned underneath the reverse flow valve member 160 and the pressure within the fuel pressurization chamber 114 to control the movement of the reverse flow valve member 160. The strength of the compressed spring 161 is great enough that the reverse flow valve member 160 will remain in its first position for a time sufficient to prevent gas ingestion into the fuel pressurization chamber 114 during peak cylinder pressure. However, the strength of the compressed spring 161 is limited such that the reverse flow valve member 160 remains in its second position for a time sufficient to allow pressurized fuel to flow into the nozzle supply passage 115 before the next injection event. The present invention allows for better control over the movement of the reverse flow valve member 160, which helps prevent fuel leakage into the engine cylinder. In the preferred embodiment, a pin 162 is operably positioned within the guide bore 154 between the reverse flow valve member 160 and the stop component 142. Because the pin 162 is received in the guide bore 154 and into the stop component 142, the pin 162 prevents the reverse flow valve member 160 from rotating with respect to the injector body 111.

Figure 5:
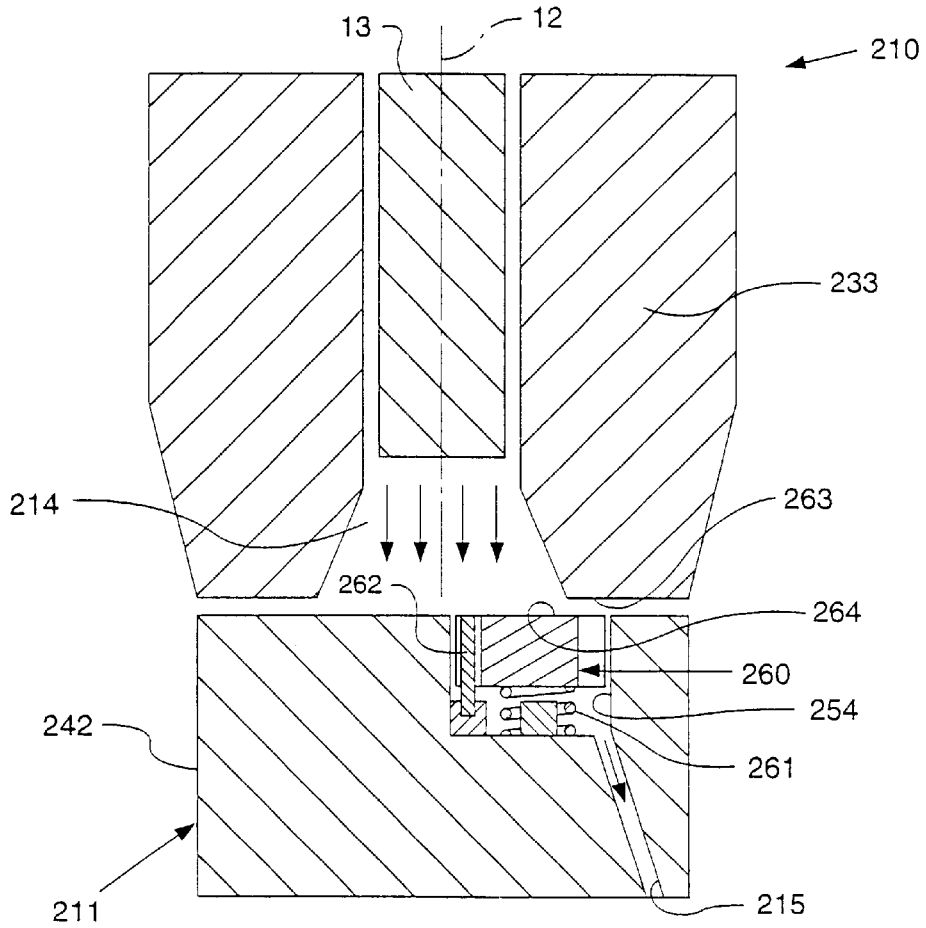
FIG. 5 is a partial sectioned side diagrammatic view of a reverse flow valve member positioned within a fuel injector according to an alternative embodiment of the present invention.
Figure 6:
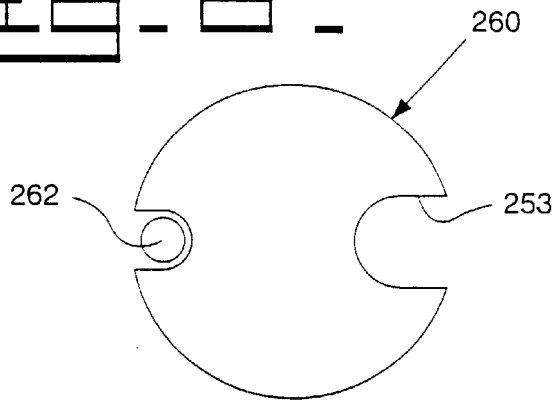
FIG. 6 is a top view of the reverse flow valve member shown in FIG. 5.

Referring to FIG. 5 and FIG. 6, there is shown a partial sectioned side diagrammatic view and a front view of a reverse flow valve member 260 according to an alternate embodiment of the present invention, respectively. Similarly as the preferred embodiment of the present invention, the reverse flow valve member 260 is trapped between a stop component 242 and a barrel 233 and is movable between a first position, or a closed position, and a second position, or an open position. The difference between the fuel injector 110 of the preferred embodiment and the fuel injector 210 of the alternate version is the shape of the reverse flow valve members 160, 260. Rather than having a cupped-shape and a hollow interior as does the reverse flow valve member 160 of the preferred embodiment, the reverse flow valve member 260 is a solid disc under which a compressed spring 261 is positioned. Just as in the preferred embodiment, a pin 262 is operably positioned within a guide bore 254 between the reverse flow valve member 260 and the stop component 242 so to prevent the reverse flow valve member 260 from rotating with respect to its injector body 211.

Figure 7:
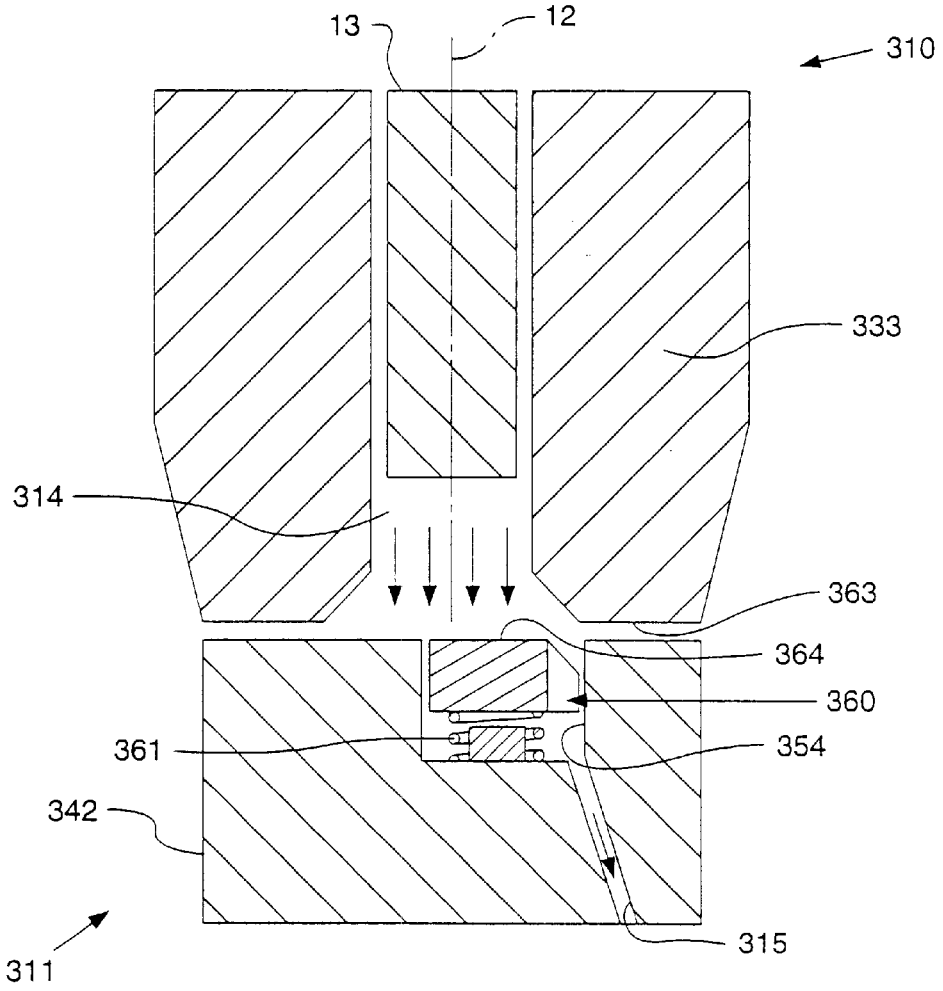
FIG. 7 is a partial sectioned side diagrammatic view of a reverse flow valve member positioned within a fuel injector according to a second alternative embodiment of the present invention.
Figure 8:
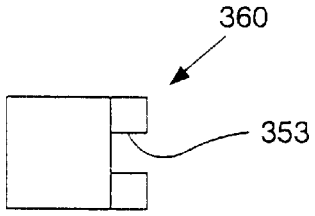
FIG. 8 is a front view of the reverse flow valve member shown in FIG. 7.

Referring to FIG. 7 and FIG. 8, there is shown a partial sectioned side diagrammatic view and a front view of a reverse flow valve member 360 according to a second alternate embodiment of the present invention, respectively. The second alternate embodiment works similar to the preferred embodiment of the present invention except for the shape of a reverse control flow valve member 360, the shape of a valve seat 364 and the interaction between the reverse flow valve member 360 and its injector body 311. Rather than having a circular shape, the reverse flow valve member 360 is rectangular. Because the reverse flow valve member 360 is solid, a compressed spring 361 is operably positioned below the reverse flow valve member 360 in order to bias the reverse flow valve member 360 to its closed position. Further, a valve seat 363 of a barrel 333 is flat and slanted rather than flat and horizontal like in the other embodiments of the present invention. Because the reverse flow valve member 360 and a guide bore 354 are rectangular, there is no need for a pin to prevent the reverse flow valve member 360 from rotating.

INDUSTRIAL APPLICABILITY

Referring to FIG. 2, operation of the present invention will be discussed for fuel injectors that pressurize fuel within their injector bodies. It should be appreciated that the present invention can operate in common rail fuel injectors in which the fuel is pressurized outside the body of the fuel injectors. Moreover, it should be appreciated that while different fuel injectors within the engine operate at different stages, the present invention operates in the same manner for each fuel injector and can be applied in an engine with any number of fuel injectors.

In the present invention, the plunger 13 is biased to its upward position under the action of its biasing spring 16. When plunger 13 is in its upward position, the pressure within the upper portion of the nozzle supply passage 115 that includes the fuel pressurization chamber 114 is at relatively low fuel supply pressure and, thus, permits the check valve 32 to open and low pressure fuel to flow from the fuel tank (not shown) to the fuel pressurization chamber 114 via the fuel supply line 130. When the plunger 13 is in its upward position, the pressure within the lower portion of the nozzle supply passage 115 acting on the opening hydraulic surface 21 of the direct control needle valve member 20 is also low. Thus, the direct control needle valve member 20 will remain in its closed position under the action of its biasing spring 22 and the hydraulic pressure within the direct control chamber 24, blocking fluid communication between the nozzle outlet 17 and the fuel pressurization chamber 114.

Prior to an injection event, the plunger 13 is driven downward by a hydraulic intensifier piston or a tappet to move along a centerline 12 of the fuel injector 110 toward its downward position. This greatly increases fuel pressure within the upper portion of the nozzle supply passage 115 which includes the fuel pressurization chamber 114 and the lower portion of the nozzle supply passage 115. The increased pressure within the fuel pressurization chamber 114 will close the check valve 32, blocking fluid communication between the fuel pressurization chamber 114 and the fuel tank (not shown) via the fuel supply line 130. The pressurized fuel will act on the opening hydraulic surface 164 of the reverse flow valve member 160 and move the reverse flow valve member 160 downward against the action of the compressed spring 161 to its second, or open, position. The reverse flow valve member 160 will move out of contact with the valve seat 163 of the barrel 133 so that the pressurized fuel can flow through to the lower portion of the nozzle supply passage 115 via the groove 153 defined by the reverse flow valve member 160 when in its second position. The direct control needle valve member 20 remains in its closed position blocking fluid communication between the nozzle outlet 17 and the nozzle supply passage 115 until the pressurized fuel acting on the opening hydraulic surface 21 of the direct control needle valve member 20 reaches a valve opening pressure sufficient to overcome the bias of the biasing spring 22 and the needle control chamber 24 is connected to low pressure via the pressure communication line 25. When the direct control needle valve member 20 moves to its open position, a stop surface of the nozzle outlet valve member 20 is in contact with the stop component 142, and the nozzle outlet 17 is opened to allow pressurized fuel to be injected into the engine cylinder (not shown).

Shortly before the desired amount of pressurized fuel is injected into the engine cylinder via the nozzle outlet 17 of the fuel injector 110, the pressure communication line 25 will connect the needle control chamber 24 with a source of high pressure actuation fluid. The direct control needle valve member 20 will close under the hydraulic force within the needle control chamber 24 and the bias of its spring 22. In its closed position, the direct control needle valve member 20 is blocking fluid communication between the nozzle outlet 17 and the nozzle supply passage 115. Those skilled in the art should appreciate that the direct needle control valve is the preferred method for operating the nozzle outlet 17. The direct needle control valve allows the nozzle outlet 17 to be closed under high pressure within the needle control chamber 24 even when there is high pressure within the nozzle supply passage 115. Thus, the nozzle outlet 17 can remain blocked despite the pressure within the nozzle supply passage 115. Although a nozzle outlet valve that is controlled solely by a biasing spring and 4 the pressure within the nozzle supply passage 115 can be used, the timing of the reverse flow valve member 160 can be important. When a nozzle outlet valve is used, if the reverse flow valve member 160 moves too quickly to its closed position, gases will be trapped within the nozzle supply passage 115 causing pressure on the hydraulic surface 21 of the nozzle valve outlet member such that it slows the closing of nozzle outlet 17. Fuel will be able to leak past the open nozzle outlet 17 and dribble into the engine cylinder causing smoke from the engine. If the reverse flow valve member 160 moves too slowly into its closed position, then the nozzle outlet 17 will close approximately at the same time as the reverse flow valve member 160 moves to its closed position. Thus, if the pressure within the engine cylinder is greater than the pressure within the nozzle supply passage 115 at the time the nozzle outlet 17 closes, some of the combustion gases will enter into the injector tip.

The hydraulic pressure acting on the plunger 13 is then reduced allowing the plunger 13 to retract along the centerline 12 to its upward position under the action of its biasing spring 16, causing the pressure within the fuel pressurization chamber 114 to decrease. The decreased pressure within the fuel pressurization chamber 114 acting on the opening hydraulic surface 164 of the reverse flow valve member 160 will be insufficient to overcome the action of the compressed spring 161. Thus, the reverse flow valve member 160 will move to its first, or closed position, under the action of the compressed spring 161. When in the first position, the reverse flow valve member 160 is in contact with a valve seat 163 of the barrel 133 and is blocking fluid communication between the fuel pressurization chamber 114 and the lower portion of the nozzle supply passage 115. In the event of gas ingestion through the tip of the fuel injector 110, the gases moving up the lower portion of the nozzle supply passage 115 will be blocked from the fuel pressurization chamber 114 by the reverse flow valve member 160, which is preferably already in its closed position due to the low pressure within the fuel pressurization chamber 114 acting on its opening hydraulic surface 164. Thus, the present invention blocks fluid communication between the fuel pressurization chamber 114 and the lower portion of the nozzle supply passage 115 during a non-injection event. This limits gas ingestion due to tip leakage to the relatively small volume below the reverse flow control valve member 160.

Recall that, with the prior art, gases occasionally are trapped within the fuel pressurization chamber 14 and the nozzle supply passage 15 by the check valve 32 and the direct control needle valve member 20. The trapped gas creates pressure within the fuel pressurization chamber 14 sufficient to prohibit the check valve 32 from rising off its seat and allowing low pressure fuel into the fuel pressurization chamber 14. Thus, the fuel pressurization chamber 14 is blocked from fluid communication with the fuel supply line 30 by the check valve 32. The pressure caused by the trapped gas acting on the opening hydraulic surface 21 within the nozzle supply passage 15 is not great enough to open the needle valve member 20. Thus, the nozzle supply passage 15 is blocked from fluid communication with the nozzle outlet 17. The plunger 13 will advance downward to pressurize the fuel, but there will be no fuel within the fuel pressurization chamber 14 because the fuel pressurization chamber 14 is blocked from the fuel supply line 30 by the closed check valve 32. The gas can never reach a high enough pressure to open the direct needle control valve member 20 and the gas pressure never drops low enough to allow the check valve 32 to lift to its open position to allow fuel into the fuel pressurization chamber 14. The plunger 13 reciprocates up and down but nothing happens with the fuel injector 10. While this gas trapping exists in the prior art, it is eliminated in the present invention. Because the movement of the reverse flow valve member 160 is controlled by pressure within the fuel pressurization chamber 114, the pressure caused by gases that travel into the fuel pressurization chamber 114 will act on the opening hydraulic surface 164 and move the reverse flow valve member 160 to its open position. The gases will flow through the groove 153 and into the nozzle supply passage 115. Thus, even if gases travel into the fuel pressurization chamber 114, they will not accumulate and be trapped.

If gases, other than combustion gases, become trapped within the fuel pressurization chamber 114 of a new fuel injector during assembly, the present invention also includes a priming feature that pushes the gas through the fuel injector 110 and out the nozzle outlet 17. The pressure caused by the gases will act on the opening hydraulic surface 164 of the reverse flow valve member 160 causing the reverse flow valve member 160 to move downward against the action of the compressed spring 161 and open fluid communication between the fuel pressurization chamber 114 and the lower portion of the nozzle supply passage 115. When the plunger 13 advances, it will push the gases through the groove 153 and into the lower portion of the nozzle supply passage 115. If there is still gas within the fuel pressurization chamber 114 sufficient to keep the check valve 32 in its closed position when the plunger 13 retracts to its upward position, fuel will not flow into the fuel pressurization chamber 114 from the fuel tank (not shown). However, the plunger 13 will again be hydraulically activated to move downwards against the action of its biasing spring 16 and increase the pressure within the fuel pressurization chamber 114. The gases will again act on the opening hydraulic surface 164 of the reverse flow control valve member 160 and open fluid communication between the fuel pressurization chamber 114 and the lower portion of the nozzle supply passage 115. The gases will once again be pushed through the groove 153 and into the nozzle supply passage 115. The reciprocating plunger 13 will continue pushing the gases out of the fuel pressurization chamber 114 into the lower portion of the nozzle supply passage 115 until the pressure within the fuel pressurization chamber 114 is low enough to allow the check valve 32 to open. Fuel can then flow from the fuel tank (not shown) to the fuel pressurization chamber 114 via the fuel supply line 130 past the check valve. As fuel flows in, repeated plunger movements will eventually achieve needle valve opening pressure allowing the compressed gas and the fuel to exit via the nozzle outlet 17. Thus, the present invention not only prevents gas trapping within the fuel pressurization chamber 114 by blocking fluid communication between the lower portion of the nozzle supply passage 115 and the fuel pressurization chamber 114, the present invention also allows fuel injector 110 to prime itself if gas trapping does occur within the fuel pressurization chamber 114.

Referring to FIGS. 5 through 8, there is shown sectioned side diagrammatic illustrations and top views of the reverse flow valve members 260, 360 according to the two alternate versions of the present invention. The reverse flow valve member 260, 360 according to the alternate versions of the present invention perform in the same manner as the reverse flow valve member 160 according to the preferred embodiment of the present invention. The difference between the three embodiments are the shapes of the reverse flow valve members 160, 260, 360 and the shape of the valve seats 163, 263, 363. For a discussion on these differences, see the Detailed Discussion section of this Application.

Both the prior art and the present invention limit the trapping of combustion gases within the fuel pressurization chambers 14, 114 by blocking fluid communication between the nozzle supply passage 15, 115 and the fuel pressurization chamber 114. However, unlike the prior art, in the event that gases, other than combustion gasses, are trapped within the fuel pressurization chamber 114 of a new fuel injector 110, the present invention can prime itself by pushing the gases out of the fuel pressurization chamber 114 and decreasing the pressure such that the check valve 32 can lift and allow fuel to flow into the fuel pressurization chamber 114. Also, this priming feature will eliminate the need for the fuel injector 110 to re-prime itself because any gas that travels into the fuel pressurization chamber 114 should eventually be pushed out of the chamber 114 by the downward strokes of the plunger 13. Moreover, unlike the prior art in which the reverse flow check 52 may not stay closed during the entire non-injection event, the reverse flow control valve member 160 of the present invention will remain closed during the entire non-injection event. Therefore, the present invention does not just reduce, but prevents, gas trapping in the fuel pressurization chamber 114 caused by gas ingestion in the injector tip. Any gases that are ingested through the tip of the fuel injector 110 will always remain in the portion of the nozzle supply passage 115 below the reverse flow valve member 160. The present invention removes the plate 50 from between the stop component 142 and the barrel 133. Thus, the seal between the stop component 142 and the barrel 133 is improved and should reduce oil to fuel transfer. Moreover, the removal of the plate 50 eliminates the potential for excessive wear and plate breakage over time.

It should be understood that the above description is intended for illustrative purposes only, and is not intended to limit the scope of the present invention in any way. Thus, those skilled in the art will appreciate that other aspects, objects, and advantages of the invention can be obtained from a study of the drawings, the disclosure and the appended claims.

What is claimed is:

1. A fuel injector comprising:

an injector body defining a nozzle supply passage and a nozzle outlet;

a reverse flow valve member positioned in the injector body and including an opening hydraulic surface exposed to fluid pressure in an upper portion of the nozzle supply passage, and being moveable between a closed position in which the nozzle supply passage is blocked, and an open position in which the nozzle supply passage is open;

a compressed spring operably positioned to bias the reverse flow valve member toward the closed position;

the injector body defines a guide bore;

the reverse flow valve member being positioned in the guide bore and having a guide clearance in the guide bore;

an interaction between the reverse flow valve member and the injector body, and being operable to prevent the reverse flow valve member from rotating with respect to the injector body.

2. The fuel injector of claim 1 wherein the interaction includes a pin in contact with the injector body and the reverse flow valve member.

3. A fuel injector comprising:

an injector body defining a nozzle outlet and including a barrel in contact with a stop component;

a reverse flow valve member trapped between the barrel and the stop component, and being movable between a first position and a second position;

a movable plunger at least partially positioned in the barrel;

a nozzle supply passage, which includes a fuel pressurization chamber, being defined by the injector body, the plunger and the reverse flow valve member;

the fuel pressurization chamber being fluidly connected to a lower portion of the nozzle supply passage when the reverse flow valve member is in the second position;

a compressed spring operably positioned in the injector body to bias the reverse flow valve member toward the first position, in which the fuel pressurization chamber is blocked from the lower portion of the nozzle supply passage;

the barrel includes a valve seat;

the reverse flow valve member being in contact with the valve seat when in the first position.

4. The fuel injector of claim 3 wherein the reverse flow valve member being moveable along a line parallel to a centerline of the plunger.

5. The fuel injector of claim 4 wherein the reverse flow valve member defines a groove that fluidly connects the plunger bore to the nozzle supply passage when in the second position.

6. The fuel injector of claim 4 including an interaction between the reverse flow valve member and the injector body, and being operable to prevent the reverse flow valve member from rotating with respect to the injector body.

7. The fuel injector of claim 6 wherein the interaction includes a pin in contact with the injector body and the reverse flow valve member.

8. A method of reducing gas ingestion in a fuel injector, comprising the step of:

moving a non-spherical reverse flow valve member at least in part with a spring to a position that blocks a downstream portion of a nozzle supply passage to an upstream portion of the nozzle supply passage; and wherein the moving step includes a step of moving the reverse flow valve member into contact with a barrel.

9. The method of claim 8 including a step of moving a stop surface of a nozzle outlet valve member out of contact with a stop component.

10. The method of claim 9 includes a step of moving the nozzle outlet valve member to a closed position.

* * * * *